US005634316A

United States Patent [19]

Leifeld

[11] Patent Number: 5,634,316

[45] **Date of Patent: *Jun. 3, 1997**

[54] METHOD AND APPARATUS FOR HANDLING FLAT COILER CANS BEFORE, DURING AND AFTER FILLING THE CANS BY A SLIVER-PRODUCING TEXTILE MACHINE

[75] Inventor: Ferdinand Leifeld, Kempen, Germany

[73] Assignee: Trützschler GmbH & Co. KG, Mönchengladbach, Germany

[ * ] Notice: The term of this patent shall not extend beyond the expiration date of Pat. No. 5,560,179.

[21] Appl. No.: 416,030

[22] Filed: Apr. 3, 1995

Related U.S. Application Data

[63] Continuation-in-part of Ser. No. 243,489, May 16, 1994.

[30] Foreign Application Priority Data

Apr. 2, 1994 [DE] Germany ..... 44 11 548.2

[51] Int. Cl.[6] ..... B65B 63/04

[52] U.S. Cl. ..... 53/116; 53/118; 53/245; 53/250; 53/251; 53/64; 53/67; 53/503; 19/159 A; 19/159 R

[58] Field of Search ..... 19/157, 159 A, 19/159 R, 160; 242/361.4, 361.5, 363; 141/163, 167, 168, 175, 250, 267, 270, 283; 53/64, 67, 70, 71, 116, 117, 118, 235, 245, 249, 250, 251, 429, 430, 473, 503

[56] References Cited

U.S. PATENT DOCUMENTS

| | | | |
|---|---|---|---|
| 3,119,212 | 1/1964 | Zytka et al. | 53/116 X |
| 4,059,185 | 11/1977 | Weber | 19/159 A X |
| 4,227,848 | 10/1980 | Kriechbaum et al. | 19/159 A X |
| 5,237,726 | 8/1993 | Gartenmann et al. | 19/159 R |
| 5,276,947 | 1/1994 | Fritschi et al. | 19/159 A |
| 5,412,845 | 5/1995 | Ueding et al. | 19/159 R |

FOREIGN PATENT DOCUMENTS

| | | | |
|---|---|---|---|
| 1325253 | 5/1961 | France | 19/159 A |
| 4018088 | 1/1991 | Germany . | |
| 4015938 | 11/1991 | Germany . | |
| 333396 | 8/1930 | United Kingdom | 19/159 A |
| 1165193 | 9/1969 | United Kingdom | 19/160 |
| 91/18135 | 11/1991 | WIPO . | |
| 94/08079 | 4/1994 | WIPO . | |

*Primary Examiner*—Daniel Moon
*Attorney, Agent, or Firm*—Spencer & Frank

[57] ABSTRACT

An apparatus for handling flat coiler cans before, during and after filling the cans with sliver by a sliver producing textile machine. The apparatus includes an empty-can storing device; a full-can storing device; an intermediate space defined between the empty-can storing device and the full-can storing device; and a sliver filling station for receiving a can to be filled. The sliver filling station includes a can-reciprocating device for moving the can back and forth while sliver is deposited thereinto. The apparatus further includes a conveyor extending between the intermediate space and the sliver filling station for moving a can to be filled into and withdrawing a filled can from the sliver filling station; and a transferring device for transferring a can to be filled from the intermediate space onto the conveyor and for transferring a filled can from the conveyor into the intermediate space.

16 Claims, 5 Drawing Sheets

METHOD AND APPARATUS FOR HANDLING FLAT COILER CANS BEFORE, DURING AND AFTER FILLING THE CANS BY A SLIVER-PRODUCING TEXTILE MACHINE

CROSS REFERENCE TO RELATED APPLICATIONS

This application is a continuation-in-part of co-pending application No. 08/243,489 filed May 16, 1994.

This application claims the priority of German Application No. P 44 11 548.2 filed Apr. 2, 1994, which is incorporated herein by reference.

U.S. patent applications Ser. No. 08/416,028 filed Apr. 3, 1995 and 08/416,029 filed Apr. 3, 1995 contain related subject matter.

BACKGROUND OF THE INVENTION

This invention relates to a method and an apparatus for handling coiler cans of elongated horizontal cross section (that is, flat cans) before, during and after filling the cans with sliver by a sliver-producing textile machine such as a drawing frame. The sliver is discharged by a stationarily supported rotary coiler head of the textile machine and is deposited in coils and, during the charging (filling) process, the coiler can is moved back-and-forth parallel to its horizontal length dimension. Before the charging process starts, an empty can is moved, for example, from an empty-can storing device, into an intermediate space between empty cans and full cans and is therefrom advanced to the filling position whereupon the can is filled with sliver in the filling position and the full can is, after completion of the filling process, moved from the filling position into the intermediate space and is further advanced therefrom, for example, to a full-can storing device. A conveyor is provided between the filling position and the intermediate space.

WO Publication No. 91/18135 discloses an arrangement where empty-can and full-can storing devices are arranged separately one behind the other. Between the two can storing devices an intermediate space for a can is provided. The intermediate space is, perpendicularly to the can storing devices, connected with the sliver filling station underneath the coiler head of a drawing frame by means of a through-going can moving device (conveyor) including chains and rollers. In operation an empty can is advanced from the empty-can storing device into the intermediate space, then forwarded by the can moving device to the sliver filling station where it is filled with sliver by the coiler head and thereafter the full can is, in the opposite direction and by the same can moving device, returned into the intermediate space and then shifted into the full-can storing device. Such a process is time consuming as concerns the coiler can replacement in the zone of the can storing devices. In particular, difficulties are involved with the perpendicular change of direction of can motion between the can storing devices on the one hand and the can moving device on the other hand. In an attempt to remedy such difficulties, at the transitional zones between the conveyor belts or conveyor chains of the can storing devices and the conveyor chain of the can moving device, filler portions are provided which fill the intermediate space to ensure that the flat cans are prevented from overturning upon transition from the storing device into the zone of the transport chain or upon transition from the zone of the transport chain into the storing device. It is a further disadvantage of the prior art arrangement that it is structurally complex and expensive and, in particular, special structural measures are required for performing the method.

SUMMARY OF THE INVENTION

It is an object of the invention to provide an improved method and apparatus of the above-outlined type from which the discussed disadvantages are eliminated and which ensures, in particular, a disturbance-free transfer of the coiler cans at high speeds between the can moving device (conveyor) on the one hand and the empty-can and full-can storing devices, on the other hand.

This object and others to become apparent as the specification progresses, are accomplished by the invention, according to which, briefly stated, the apparatus for handling flat coiler cans before, during and after the cans are filled with sliver by a sliver producing textile machine, includes an empty-can storing device; a full-can storing device; an intermediate space defined between the empty-can storing device and the full-can storing device; and a sliver filling station for receiving a can to be filled. The sliver filling station includes a can-reciprocating device for moving the can back and forth while sliver is deposited thereinto. The apparatus further includes a conveyor extending between the intermediate space and the sliver filling station for moving a can to be filled into and withdrawing a filled can from the sliver filling station; and a transferring device for transferring a can to be filled from the intermediate space onto the conveyor and for transferring a filled can from the conveyor into the intermediate space.

The transfer of the coiler cans from the conveyor into the can storing device and conversely facilitates the reversal of direction and thus permits a rapid exchange so that an overall high working speed may be achieved which encompasses the can replacement and the filling of the cans by sliver. At the same time, the method according to the invention permits a high production rate of the sliver producing machine (drawing frame). In up-to-date drawing frames operating with sliver delivery speeds of over 1,000 m/min, the rapid filling of the sliver into the cans, combined with the rapid can replacement according to the invention, results in a higher degree of efficiency of the sliver producing machine. The high sliver speed makes possible a rapid charging of the can, and such a high output rate is rendered possible to a large extent by the short-path and rapid can exchange.

The invention has the following additional advantageous features:

- The can transferring device may change its location, for example, it may be mounted on the can conveyor (sled) for moving therewith.
- The transferring device is arranged in a stationary manner.
- The transferring device is associated with one end of the conveyor and the intermediate space in the can storing device.
- The transferring device has a reciprocating transfer element such as a push-pull element.
- The transfer element is driven.
- The empty-can storing device and the full-can storing device form a common structure.
- The can storing device has a common transporting device, for example, a conveyor belt for the empty cans and the full cans.
- A driving device such as an electric motor is provided for the conveyor of the can storing device.
- One end of the can conveyor laterally abuts the can storing device.
- Between the can conveyor and the can storing device a narrow clearance is provided.

A vertical overlap exists between the can conveyor and the can storing device.

An electronic control and regulating device, for example, a microcomputer is provided which is connected to the drive motor for the can conveyor.

The control and regulating device is connected to the driving device for the can transferring device.

The control and regulating device is connected to the driving device for the can storing device.

A sensor indicating the fill level of the coiler can is connected to the control and regulating device.

A path sensor, for example, an incremental path sensor indicating the location of the can on the filling path and on the conveying path is connected with the control and regulating device.

DESCRIPTION OF THE PREFERRED EMBODIMENTS

Figure 1A:
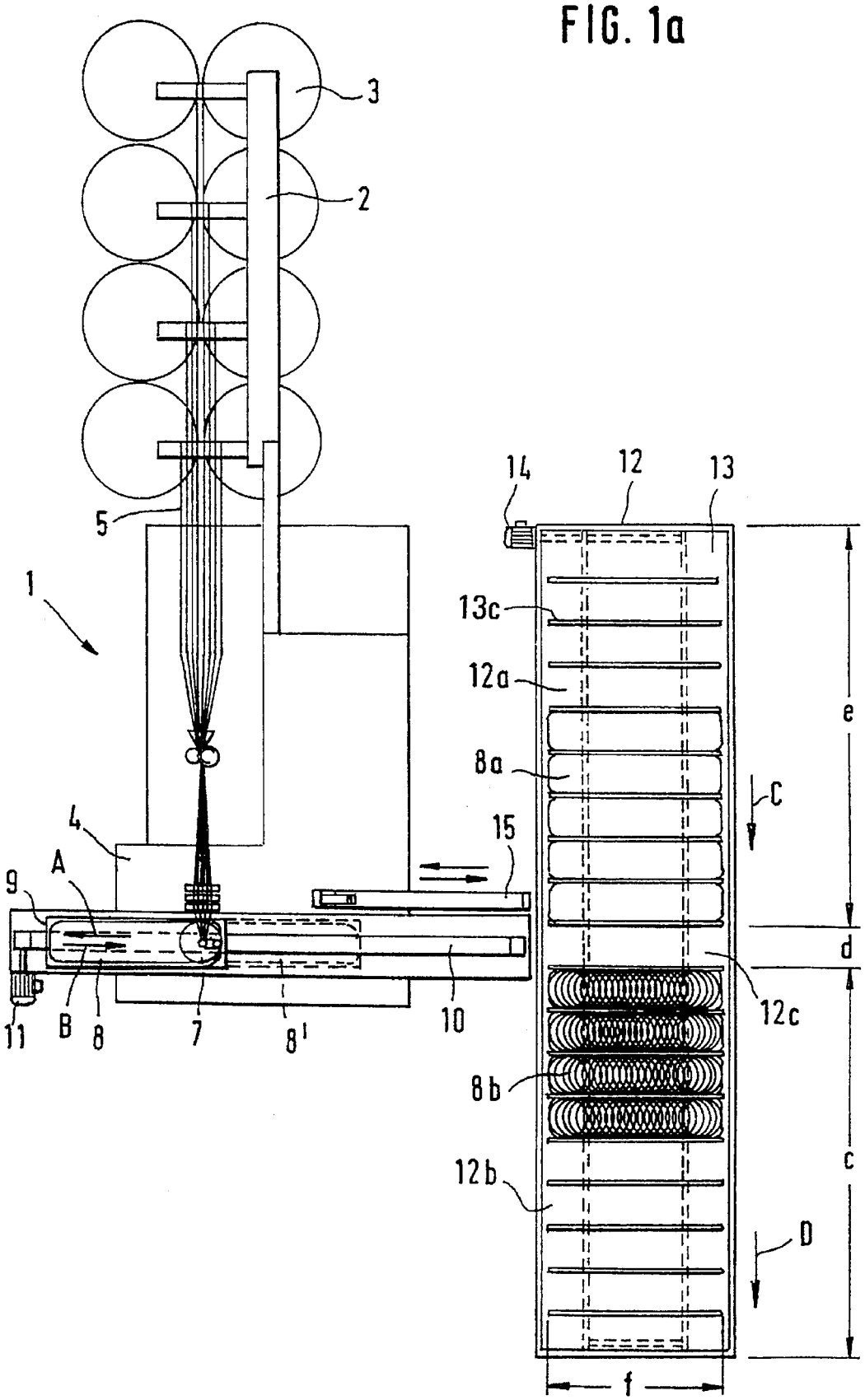
FIG. 1*a* is a schematic top plan view of a drawing frame, a can filling mechanism as well as a can conveying mechanism and a can storing device.

Turning to FIG. 1*a*, there is illustrated therein a drawing frame 1 which may be, for example, an HS 900 model manufactured by Trützschler GmbH & Co. KG, M önchengladbach, Germany. To the sliver guiding table 2 of the drawing frame 1 eight coiler cans 3 are transported from a non-illustrated carding machine. In operation of the drawing frame 1, eight slivers 5 are withdrawn from cans 3, guided over the sliver guiding table 2, and advanced to a drawing unit 4 of the drawing frame 1. The thickness of the sliver outputted by the drawing frame corresponds to the thickness of the individual inputted slivers. The sliver 6 produced by the drawing frame 1 is deposited by a coiler head 7, which forms part of the drawing frame 1, into a coiler can 8 which, after it is filled, is moved away from under the coiler head 7. The coiler can 8 is a flat can having an elongated, generally rectangular horizontal cross-sectional outline. After the coiler can 8 has been moved away from the coiler head 7, it is advanced via a can storing device 12 and a non-illustrated can transporting vehicle to a non-illustrated further processing unit, such as an open end spinning machine.

Figure 1B:
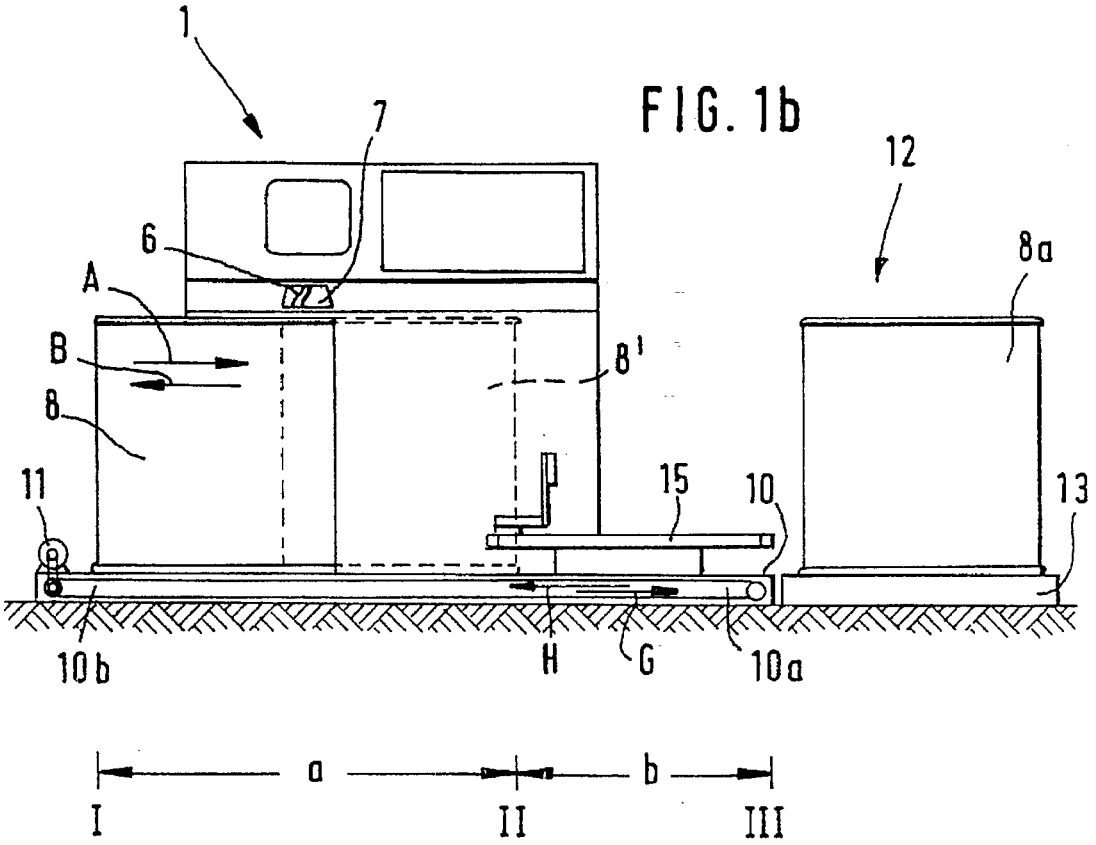
FIG. 1*b* a schematic side elevational view of the construction illustrated in FIG. 1*a*.

FIG. 1*b* shows the filling station which is arranged under the coiler head 7 and which supports a coiler can 8. The coiler head 7, supported in a non-illustrated frame, deposits the sliver 6 in coils as it rotates about a stationary axis. The sliver 6 is advanced to the coiler head 7 in a conventional manner by two cooperating calender rolls after exiting from the drawing unit 4 of the drawing frame 1. The diameter of the coiler head 7 approximately corresponds to the horizontal width measured between two opposite large vertical sides of the coiler can 8. As seen in FIG. 1*a*, the coiler can 8 is supported on a sled, carriage or similar component of a can conveyor 10. During the filling process the conveyor sled 9 executes a back-and-forth travel effected by the drive of the conveyor 10 in the direction of arrows A and B. As a result, the can reciprocates underneath the coiler head 7 along a filling path a generally corresponding to the horizontal length of the coiler can and having reversal points (end points) I and II. The can replacement motion extends beyond the filling path a and defines a conveying path b having end points II and III. In FIG. 1*b* the coiler can 8 is shown in solid lines at the left end of the filling path and it is shown in phantom lines at 8' at the right end of the filling path a. The conveyor 10 is driven by an rpm-regulatable electric motor 11.

Parallel to the longitudinal side of the drawing frame 1 a can storing unit 12 is provided which is formed of an empty-can storing device 12*a* for the empty cans 8*a* and a full-can storing device 12*b* for the full cans 8*b*. As viewed in the direction of motion indicated by the arrows C and D, between the last empty can 8*a* and the first full can 8*b* an intermediate space 12*c* is provided. The empty cans and full cans 8*a* and 8*b*, respectively, are supported on a conveyor belt 13 which is an endless member supported by end rollers 13*a* and 13*b* and is circulated by an electric motor 14. Thus, the empty-can storing device 12*a*, the intermediate space 12*c* and the full-can storing device 12*b* may be viewed as respective consecutive stationary zones 12*a*, 12*c* and 12*b* of the conveyor belt 13.

Prior to the filling step an empty coiler can 8*a* is moved from the empty-can storing device 12*a* into the intermediate space 12*c* between the empty-can storing device 12*a* and the full-can storing device 12*b* and therefrom the can is advanced to the filling station. After the filling process the full can 8 is moved by the sled 9 of the conveyor 10 from the filling station into the intermediate space 12*c* from which the can is moved to the full-can storing device 12*b*. The conveyor 10 is oriented perpendicularly to the can storing unit 12 and thus transports the cans individually to and from the filling station below the coiler head 7. Therefore, on the conveying path b either an empty can 8*a* is moved from the can storing unit 12 into the filling station or a full can 8*b* is moved from the filling station into the storing unit 12.

A transferring device 15 is provided to transfer an empty can 8*a* from the intermediate space 12*c* to the conveyor 10 and to transfer a full can 8*b* after the filling process from the conveyor 10 into the intermediate space 12*c*.

Figure 1C:
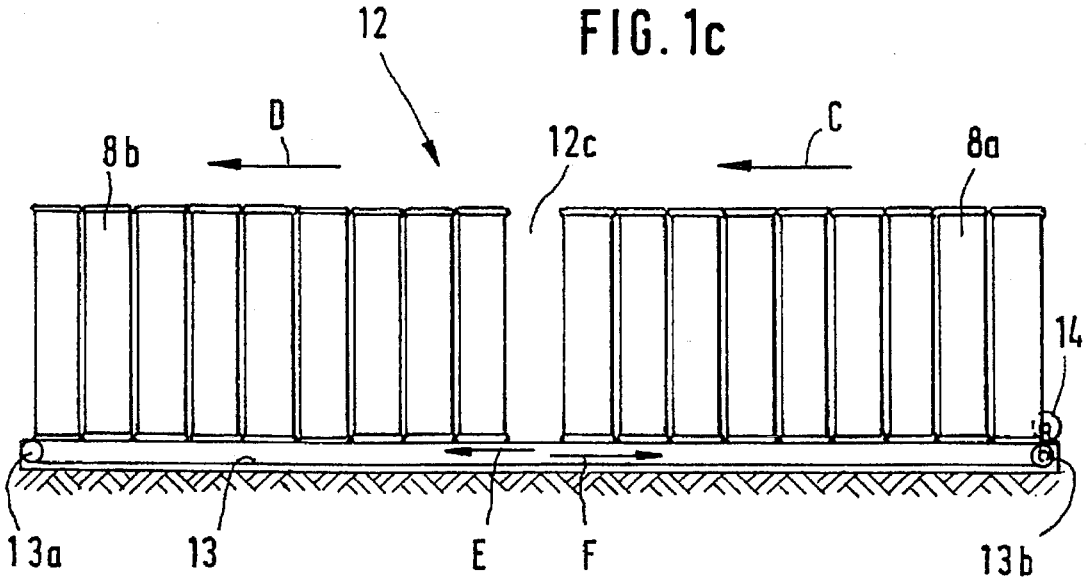
FIG. 1*c* is a schematic side elevational view of the can storing device shown in FIG. 1*a*.

Turning now to FIG. 1*c*, the empty-can storing device 12*a* and the full-can storing device 12*b* form a common can storing unit 12 constituted by a single structural unit. The can storing unit 12 has a common, throughgoing, endless conveyor belt 13 which is supported by end rollers 13*a* and 13*b* and which is circulated such that its working (upper) run moves in the direction of the arrow E, whereas its lower (idle or return) run moves in the direction of the arrow F. The conveyor belt 13 has carrier strips 13*c* which, as may be best observed in FIG. 1*a*, extend perpendicularly to the conveying direction C, D of the conveyor belt 13 and define individual compartments for accommodating individual coiler cans. The end roller 13*b* is driven by the electric motor 14. The conveyor belt 13 has a small overall structural height.

Figure 1D:
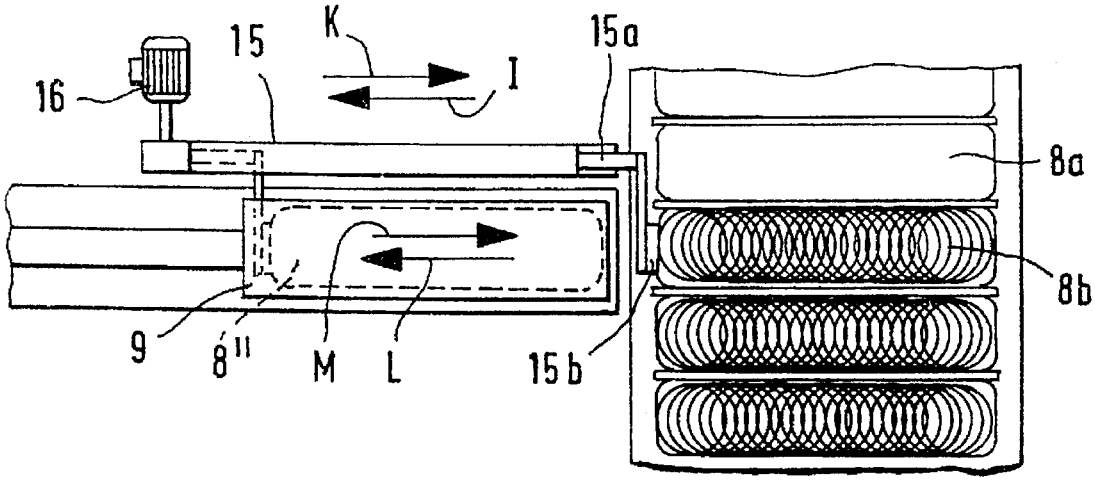
FIG. 1*d* is a schematic top plan view of a preferred embodiment of a can transferring device according to the invention.

Turning to FIG. 1*d*, there is illustrated therein the can transferring device 15 including a pushing and pulling arm 15*a* which is displaceable by a pushing and pulling element 15*b* in the direction of the arrows I and K. The pushing and pulling element 15*b* is driven by an electric motor 16. It is to be understood that instead of an electric motor a fluid displacement motor may be used as well.

Figure 2:
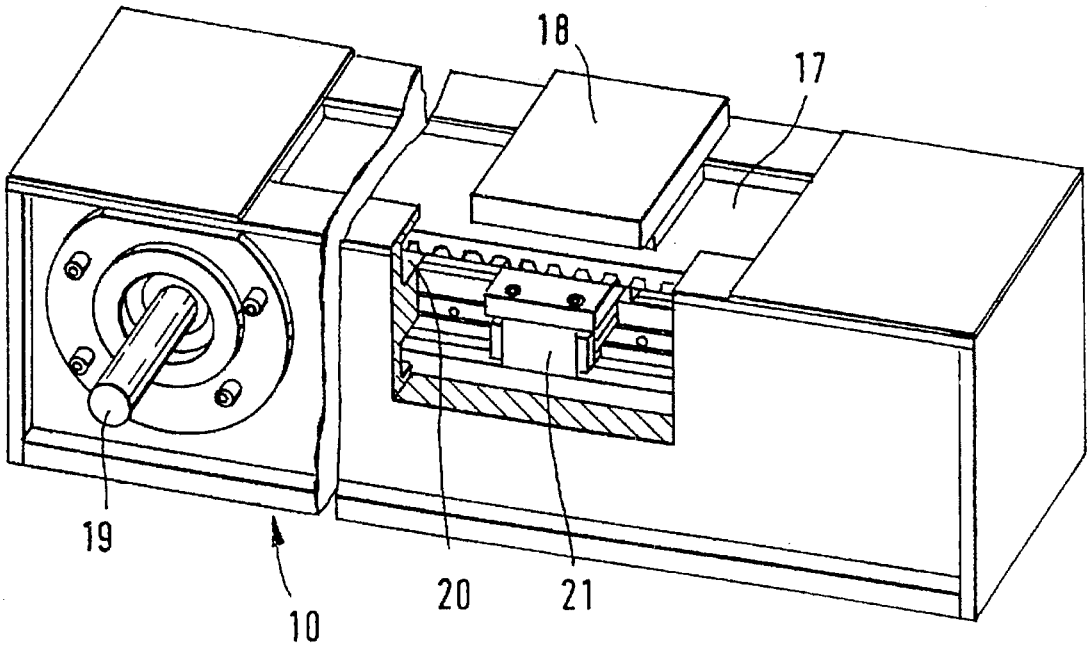
FIG. 2 is a perspective, partially broken-away view of a can conveyor according to the invention.

As shown in FIG. 2, the conveyor 10 which operatively couples the intermediate space 12*c* with the sliver filling station underneath the coiler head 7, has a toothed belt 17 on which a mounting plate 18 is secured for positioning the sled 9 thereon. The stub shaft 19 for driving the non-illustrated end roller for the belt 17 is coupled to the reversible drive motor 11. The belt 17 is guided in a slide strip 20 and a guide 21.

Figure 3:
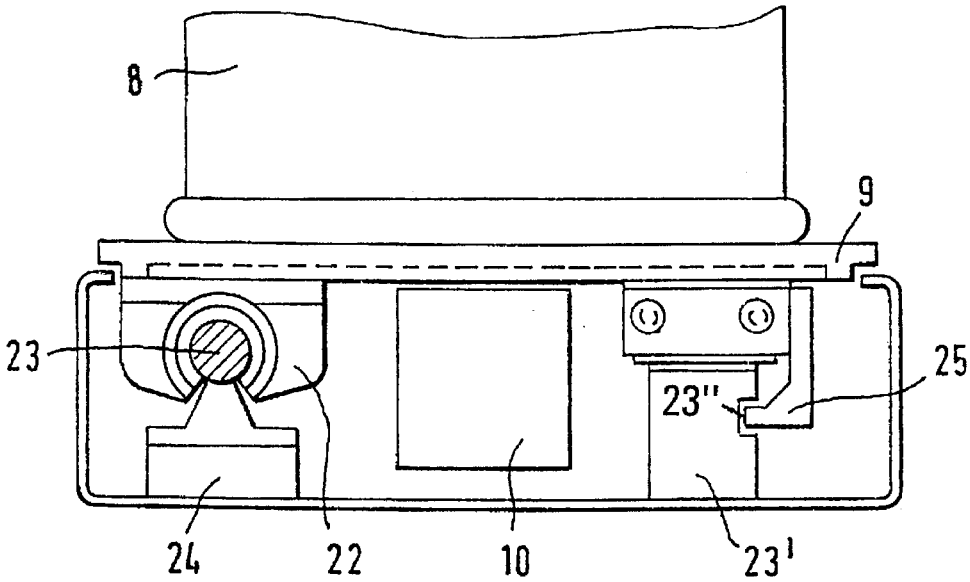
FIG. 3 is a sectional front elevational view of the can conveyor shown in FIG. 2.

As shown in FIG. 3, the flat can 8, whose horizontal width dimension faces the viewer, is positioned in a longitudinal orientation on the sled 9 which carries at its underside a sliding guide 22 partially circumferentially surrounding a stationary guide rod 23 supported on a carrier block 24. A further guide rod 23' is spaced parallel to the guide rod 23 and is formed as a sliding track for the other side of the sled 9 which is guided by the cooperation between a guide lug 25 travelling with the sled 9 and a guide track 23" provided laterally in the guide rod 23'.

Figure 4:
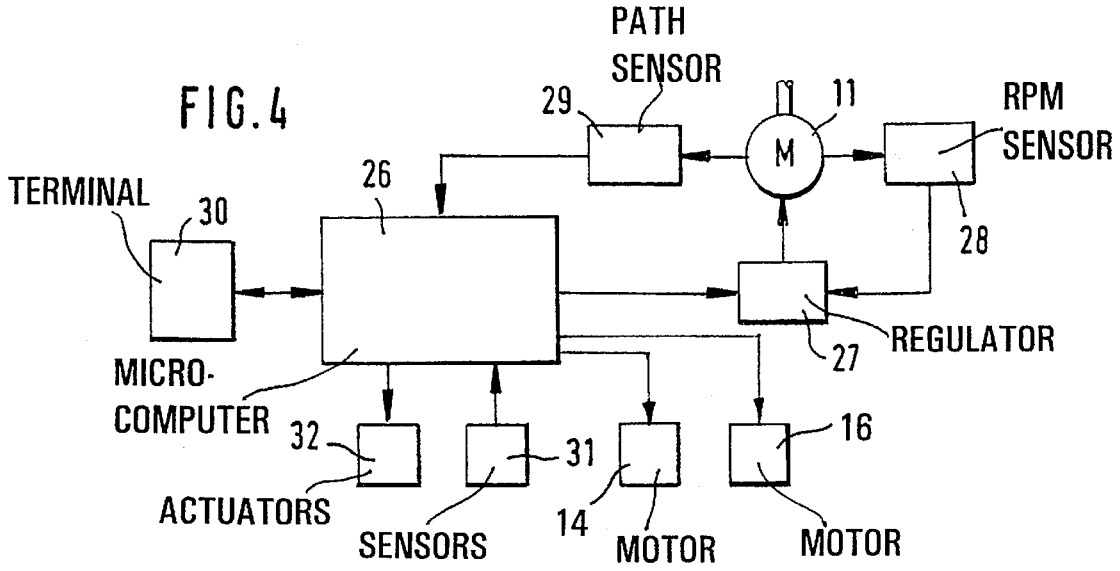
FIG. 4 is a block diagram of an electronic control and regulating device for operating the can handling apparatus according to the invention.

Turning to FIG. 4, there is provided an electronic control and regulating device, such as a microcomputer 26 to which an input of the electric motor 11 is connected with the interposition of a motor regulator 27. The drive motor 11 is connected with the microcomputer 26 with the interposition of a path sensor 29 which may be, for example, an incremental path sensor. The microcomputer 26 is further connected with a terminal 30, sensors 31 and actuators 32, the motor 16 for the can transferring device 15, the motor 14 for the can storing unit 12 as well as measuring and setting members for the control and regulation of the drawing frame 1.

The path sensor 29 applies signals to the microcomputer 26 representing the momentary position of the can 8 to be filled with sliver. The length of the filling path a on which the can is reciprocated during the filling step has structural characteristics (such as, for example, reversal point I=0 and reversal point II=100) which are stored in the microcomputer 26 according to a particular program. As long as the can is not full, it is reciprocated with a predetermined speed v along the filling path a between the two end points I and II. As soon as the maximum fill is reached which is determined by a fill level sensor 31, the can 8 is moved beyond the terminal point II towards the terminal point III along the conveying path b. Therefrom the can is laterally advanced and a new empty can 8*a* is brought to point III where the can is contacted and moved into the zone of the filling path a. Thereafter, a new filling process may start.

Figure 5A:
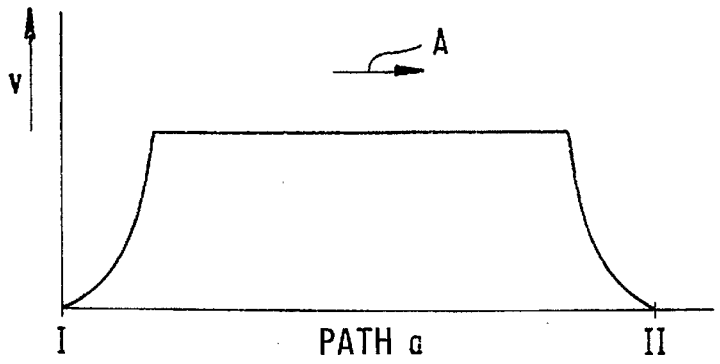
FIGS. 5*a* and 5*b* are diagrams illustrating the displacement speed of a can as a function of its position along the filling path.
Figure 5B:
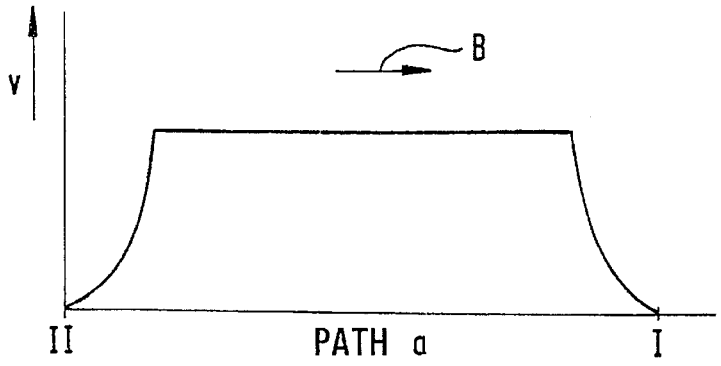

The speed v with which the can 8 is reciprocated between the end points I and II of the charging path a is variable and may be stored in the microcomputer 26 and may be applied thereby to the motor regulator 27 dependent on requirements. In particular, shortly before reaching the end points, the conveyor 10 may be braked according to a programmed course. Upon reaching a point of reversal, the direction of motion is reversed and the can is accelerated according to a programmable function as shown, for example, in FIGS. 5*a* and 5*b*. For example, the electric motor 11 may be constantly accelerated or decelerated. It may be expedient to equalize the overlap of the sliver coils at the points of reversal by the acceleration or deceleration. The speed v with which the can 8 is moved on the filling path a during the filling process is dependent from the output speed of the fiber processing machine (drawing frame) 1 and is electronically directly synchronized therewith.

The speed with which the can 8 is moved on the conveying path b may be adapted to the can filling process.

The invention also encompasses an embodiment where the device 10 directly displaces the can 8 which is moved on a conveyor apparatus, such as a roller track.

It will be understood that the above description of the present invention is susceptible to various modifications, changes and adaptations, and the same are intended to be comprehended within the meaning and range of equivalents of the appended claims.

What is claimed is:

1. An apparatus for filling flat coiler cans with sliver by a sliver producing textile machine, comprising (a) a continuous first conveyor having a conveying direction and including
  (1) a first zone forming a stationary empty-can storage zone;
  (2) a second zone forming a stationary intermediate zone; and
  (3) a third zone forming a stationary full-can storage zone; said first, second and third zones being arranged consecutively in said conveying direction;

(b) drive means for moving the first conveyor in said conveying direction to advance an empty can thereon from said first zone into said second zone and to advance a full can thereon from said second zone into said third zone;

(c) a sliver filling station for receiving a can to be filled; said sliver filling station including a can-reciprocating device for moving the can to be filled back and forth while sliver is deposited thereinto;

(d) a second conveyor extending between said second zone and said sliver filling station for moving a can to be filled into and withdrawing a filled can from said sliver filling station; said second conveyor terminating externally of said second zone; and (e) a transferring device situated adjacent said second conveyor for transferring a can to be filled from said second zone onto said second conveyor and for transferring a filled can from said second conveyor into said second zone.

2. The apparatus as defined in claim 1, further comprising a control and regulating device; said drive means comprising a motor for driving said first conveyor; said motor being connected to said control and regulating device.

3. The apparatus as defined in claim 1, further comprising a narrow clearance defined between an end of said second conveyor and said second zone.

4. The apparatus as defined in claim 1, wherein said transferring device is mounted on said second conveyor for travel therewith.

5. The apparatus as defined in claim 1, wherein said transferring device is stationarily supported.

6. The apparatus as defined in claim 1, wherein said transferring device includes a transfer element for engaging a coiler can and means for reciprocating said transfer element.

7. The apparatus as defined in claim 1, further comprising a control and regulating device and a motor for driving said second conveyor; said motor being connected to said control and regulating device.

8. The apparatus as defined in claim 1, further comprising a control and regulating device and a motor for driving said transferring device; said motor being connected to said control and regulating device.

9. The apparatus as defined in claim 1, further comprising a control and regulating device and a sensor means for determining a fill level of a coiler can; said sensor means being connected to said control and regulating device.

10. The apparatus as defined in claim 1, wherein said first conveyor includes a conveyor belt.

11. The apparatus as defined in claim 10, further comprising carrier strips secured to said conveyor belt in an orientation perpendicular to said conveying direction.

12. The apparatus as defined in claim 1, wherein said second conveyor includes an endless driving element, means for supporting said endless driving element and means for circulating said endless driving element.

13. The apparatus as defined in claim 12, further comprising a platform mounted on said endless driving element for accommodating a coiler can.

14. The apparatus as defined in claim 12, wherein said endless driving element is a conveyor belt.

15. The apparatus as defined in claim 1, wherein said can-reciprocating device includes said second conveyor; said second conveyor defining a first length portion forming a filling path along which a coiler can supported on said second conveyor is reciprocated and a conveying path along which a coiler can supported on said second conveyor is moved into and out of said sliver filling station.

16. The apparatus as defined in claim 15, further comprising a control and regulating device and a path sensor means for determining a position of a coiler can on said filling path and on said conveying path; said path sensor being connected to said control and regulating device.

* * * * *